US005161993A

United States Patent [19]

Leibfried, Jr.

[11] Patent Number: 5,161,993

[45] Date of Patent: Nov. 10, 1992

[54] RETENTION SLEEVE FOR COUPLING NUT FOR COAXIAL CABLE CONNECTOR AND METHOD FOR APPLYING SAME

[75] Inventor: Richard G. Leibfried, Jr., Mechanicsburg, Pa.

[73] Assignee: AMP Incorporated, Harrisburg, Pa.

[21] Appl. No.: 841,663

[22] Filed: Mar. 3, 1992

[51] Int. Cl.[5] ..... H01R 4/38

[52] U.S. Cl. ..... 439/320; 439/578

[58] Field of Search ..... 439/310, 320, 321, 322, 439/578, 583, 584, 585

[56] References Cited

U.S. PATENT DOCUMENTS

| | | | |
|---|---|---|---|
| 4,545,637 | 10/1985 | Bosshard et al. | 439/578 |
| 4,596,434 | 6/1986 | Saba et al. | 439/578 |
| 4,698,028 | 10/1987 | Caro et al. | 439/578 |
| 5,002,503 | 3/1991 | Campbell et al. | 439/578 |

*Primary Examiner*—Larry I. Schwartz
*Assistant Examiner*—Hien D. Vu
*Attorney, Agent, or Firm*—Anton P. Ness

[57] ABSTRACT

A coaxial connector (100) having a coupling nut (12) freely rotatable therearound has a rear stop defined by the forward end (152) of a retention sleeve (150) placed along the central section (128) of the outer conductive shell (120). The retention sleeve rearward end (160) defines a forward stop for a crimping ferrule (196) placed over the reduced diameter rearward shell section (134) and trapping an end of a shielding braid (184) therebetween to be crimped. The retention sleeve includes a rearward section (156) having an inner diameter incrementally less than the outer diameter of the central section (128) of the outer conductive shell so that the retention sleeve (150) is force fittable thereonto and self-retains thereon. A method of assembly includes pushing the retention sleeve forwardly onto the central shell section until the annular tool work end (172) abuts the rearwardly facing surface (144) defined between the central shell section (128) and the reduced diameter rearward shell section (134), thereby precisely positioning the retention sleeve along the outer conductive shell (120).

2 Claims, 4 Drawing Sheets

RETENTION SLEEVE FOR COUPLING NUT FOR COAXIAL CABLE CONNECTOR AND METHOD FOR APPLYING SAME

FIELD OF THE INVENTION

This relates to the field of electrical connectors and more particularly to coaxial cable connectors having coupling nuts.

BACKGROUND OF THE INVENTION

Certain connectors for coaxial cable which are commercially available, include a coupling nut assembled to the outer conductive shell which threadedly couples with the outer conductive shell of a mating connector to bring together and retain the connectors in an assuredly mated condition to interconnect a coaxial cable to another like cable or to an electrical apparatus or the like. The connector includes an inner contact or inner conductor which is terminated to the signal conductor of the coaxial cable and which is held precisely centered within a dielectric sleeve secured to and within an outer conductive shell having a rearwardly extending section to which the cable's shield is terminated; the inner and outer conductors electrically engage at a mating face with complementary conductors of the mating connector upon mating. The coupling nut is secured to the outer conductor in a manner permitting rotation thereabout but is stopped from axial movement therealong; the coupling nut is rotated about the first connector to become fully threaded to the mating connector, incrementally drawing the mating connector toward the first connector and its mating face firmly against the mating face of the first connector for the complementary inner and outer conductors to become electrically connected.

One particular such coaxial connector is sold by AMP Incorporated, Harrisburg, Penna. under the designation SMA Plug Connector and having Part No. 447647-5, matable with an SMA Bulkhead Jack such as Part No. 447650-5. In this connector assembly, the coupling nut is secured about the front section of the outer conductor and includes an inwardly directed flange at its rearward end which defines a forwardly facing surface opposing a rearwardly facing stop surface of a collar of the outer conductor to establish a forward stop. A crescent clip or C-clip is secured to the outer conductor, seated within an annular groove into the central section just rearwardly of the rearward end of the coupling nut, to define a forwardly facing surface opposing the rearward surface of the coupling nut to establish a rearward stop. A reduced diameter crimping section of the outer conductor extends rearwardly from the central section at a transition location which provides the seat for the rearward end of the dielectric sleeve containing the inner contact; the crimping section provides a cylindrical surface around which the braid of the coaxial cable is drawn, to be crimped thereto after a crimping ferrule is placed about the braid, to establish the electrical connection of the outer conductor to the shielding braid of the cable. A second C-clip is secured to the outer conductor at the transition location in order to provide a clearly defined forward stop for the braid and the crimping ferrule, at an axial location appropriately spaced at the rearwardmost end of the inner contact of the connector and its electrical connection to the signal conductor of the cable which extends forwardly of the inner insulating jacket of the cable, for the crimping deformation not to affect the concentric precisely dimensioned relationship between the inner surface of the outer conductor and the inner contact and to provide minimum impedance mismatch.

It is desired to provide a simpler assembly procedure for a coaxial connector having a coupling nut retained thereon, with fewer parts.

SUMMARY OF THE INVENTION

The present invention provides a retention sleeve for placement on the conductive shell or outer conductor of a coaxial connector and having a forward end which defines the rearward stop for coupling nut retention, and also a rearward end establishing the forward stop for the cable braid and the crimping ferrule. The retention sleeve includes an inner diameter incrementally larger than the outer diameter of the central section of the outer conductor, and a reduced inner diameter section of short axial length to establish an interference fit with a portion of the central outer conductor portion just forwardly of the transition location to the reduced diameter crimping section at the rearward end of the outer conductor. Tooling pushing the retention sleeve onto the outer conductor includes a forward end abutting the rearward end of the retention sleeve is stopped by the rearwardly facing surface defined by the transition of the outer conductor from the central section to the reduced diameter crimping section, so that the rearward end of the retention sleeve is coplanar with the rearwardly facing surface of the outer conductor at the transition location and effectively creates a wide annular ledge assuredly stopping the cable braid and crimping ferrule during crimping.

It is an objective of the present invention to provide a sleeve adapted to be easily applied onto and self retaining on the central section of an outer conductor of a commercially accepted coaxial connector having proven impedance performance, to provide retention of the existing coupling nut on the outer conductor and appropriately locate the forward limit of the crimping region for the cable braid and existing crimping ferrule for the connector.

An embodiment of the present invention will now be described by way of example with reference to the accompanying drawings.

DETAILED DESCRIPTION OF THE PREFERRED EMBODIMENT

Figure 1:
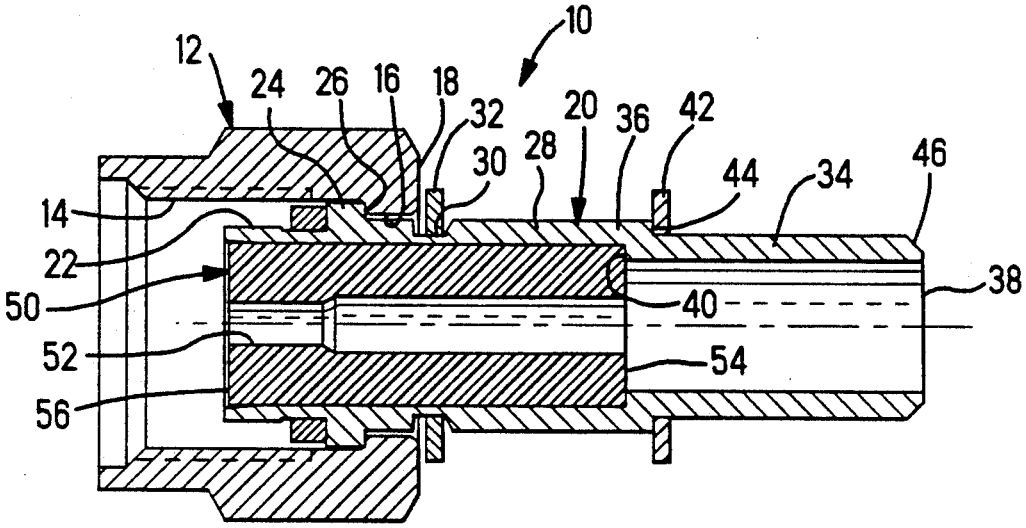
Fig. 1 PRIOR ART
FIG. 1 is a longitudinal section view of a coaxial connector of the prior art, having a pair of C-clips secured about the outer conductor rearwardly of the coupling nut.
Figure 2:
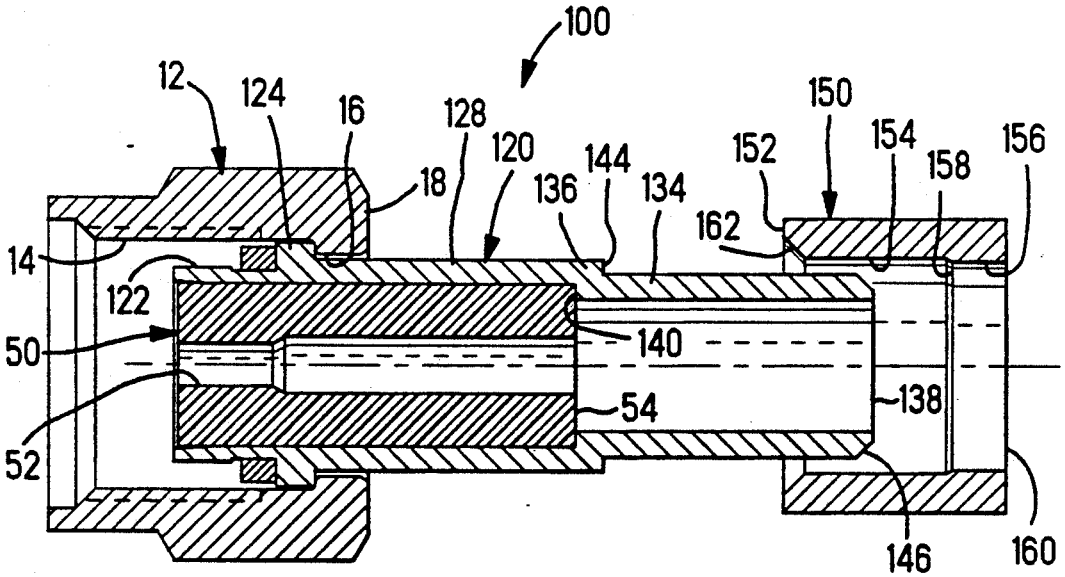
FIGS. 2 to 4 are longitudinal section views of the connector of the present invention, with the coupling nut positioned around the outer conductor and the retention sleeve being inserted onto the rearward end of the outer conductor, with FIG. 3 showing the sleeve about to be force fit at the transition location, and FIG. 4 showing full sleeve assembly.
Figure 3:
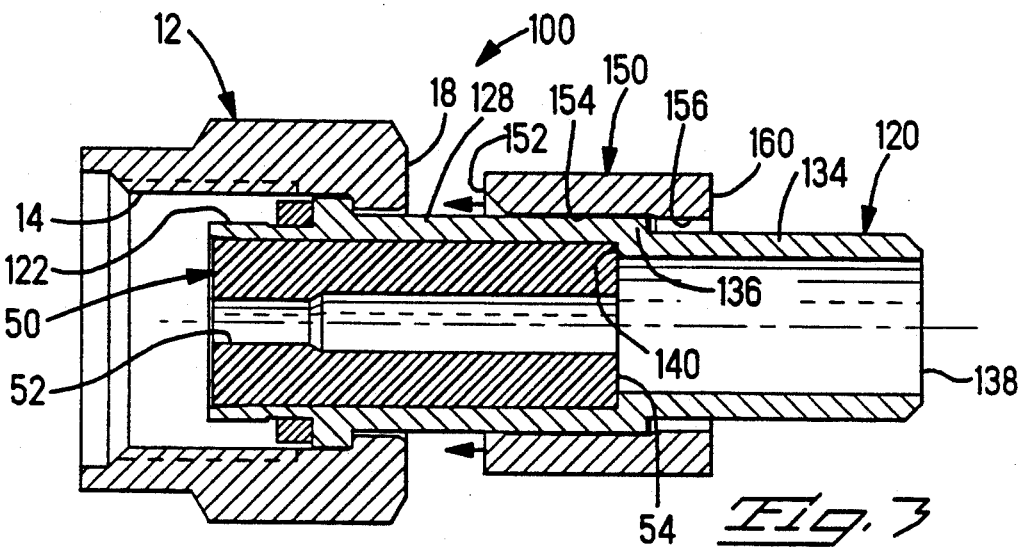

A PRIOR ART coaxial connector 10 is illustrated in FIG. 1, in which the coupling nut 12 is secured onto the forward section 22 of the conductive shell or outer conductor 20 and includes a threaded forward portion 14 for threadedly receiving a correspondingly threaded outer surface of the conductive shell or outer conductor of a mating connector (not shown). Coupling nut 12 includes an inwardly directed flange 16 at rearward nut end 18 which has an inner diameter less than the outer diameter of a collar 24 of outer conductor 20, so that rearwardly facing surface 26 of collar 24 defines a forward stop for coupling nut 12. A dielectric sleeve 50 is secured within forward section 22 and central section 28 of outer conductor 20 and contains a central passageway 52 extending from rearward sleeve end 54 to forward sleeve end 56, in which can be placed an inner contact (see FIG. 7), precisely centered within the outer conductor having a precisely selected inside diameter for optimum impedance performance.

Central section 28 of outer conductor 20 includes an annular groove 30 in which is placed a first crescent or C-clip 32 just rearwardly of the rearward end 18 of coupling nut 12, establishing a rearward stop for retention of coupling nut 12 on outer conductor 20. A reduced diameter crimping section 34 extends rearwardly from central section 28 of outer conductor 20 at transition location 36 to a rearward cable-receiving end 38; transition location 36 includes a forwardly facing ledge 40 around its inner surface which defines the rearward stop for rearward end 54 of dielectric sleeve 50 during insertion. A second C-clip 42 is secured onto crimping section 34 abutting the rearwardly facing ledge 44 at transition location 36 to provide the forward stop for the end of the cable braid and crimping ferrule placed around the crimping section 34 of the outer conductor 20 to be crimped thereto by conventional tooling (see FIG. 7). Rearward end 38 of outer conductor 20 is preferably chamfered at 46 to assist in drawing the cable braid thereover during cable termination.

FIGS. 2 through 7 illustrate the present invention embodied in coaxial connector 100. Outer conductor 120 may be identical to outer conductor 20 of the FIG. 1 (Prior Art) coaxial connector, or may optionally contain no annular groove comparable to groove 30 of outer conductor 20 used to seat C-ring 32 thus simplifying outer conductor fabrication. Dielectric insert 50 and coupling ring 12 are identical to those of FIG. 1. Retention sleeve 150 is insertable over crimping section 134 from rearward end 138 of outer conductor 120, and includes a forward end 152, forward section 154 and rearward section 156 joined to forward section 154 at transition section 158 and extending to rearward end 160. The inside edge 162 of forward end 152 is chamfered to facilitate assembly onto crimping section 134 and passing over transition section 136.

Figure 5:
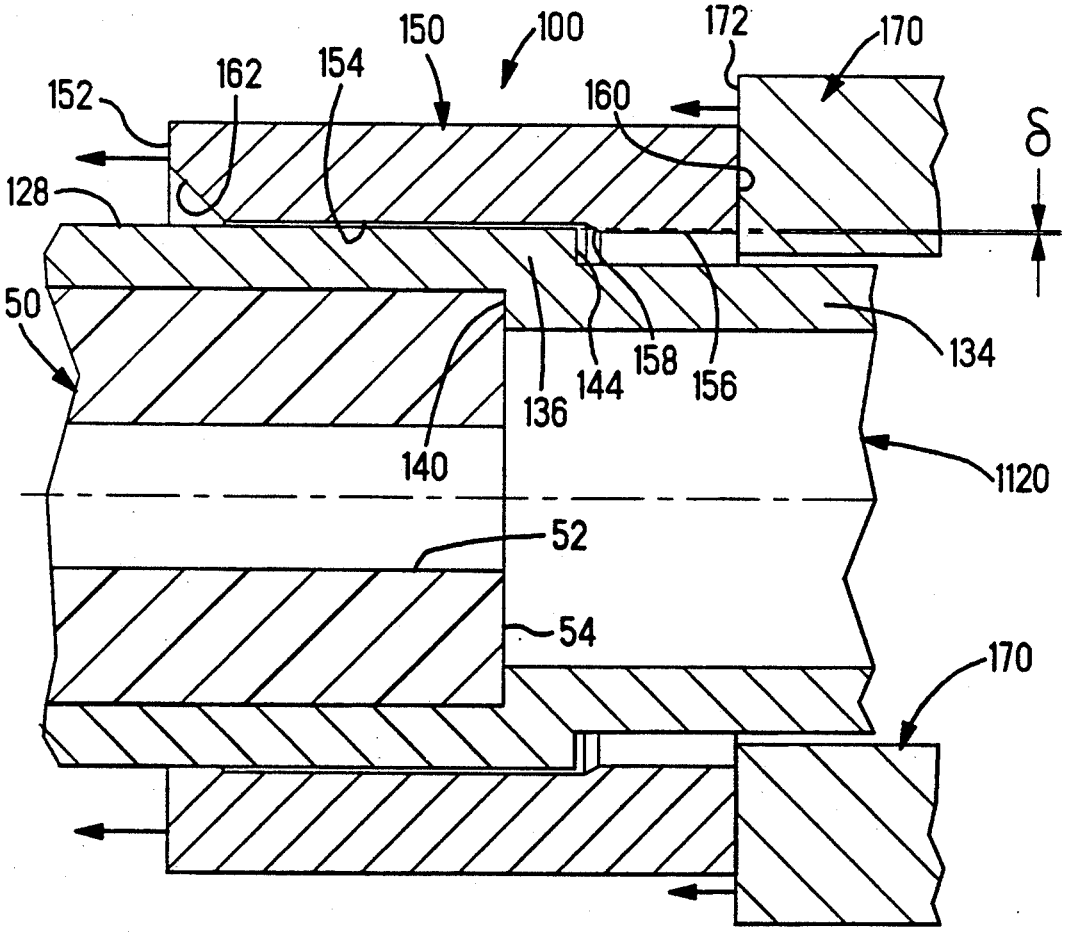
FIGS. 5 and 6 are enlarged section views of the retention sleeve around the outer conductor just prior to, and just after, respectively, being force fit thereto by tooling at the transition location, illustrating the reduced diameter rearward section of the retention sleeve in relation to the outer conductor outer diameters thereat, corresponding to FIGS. 3 and 4.
Figure 4:
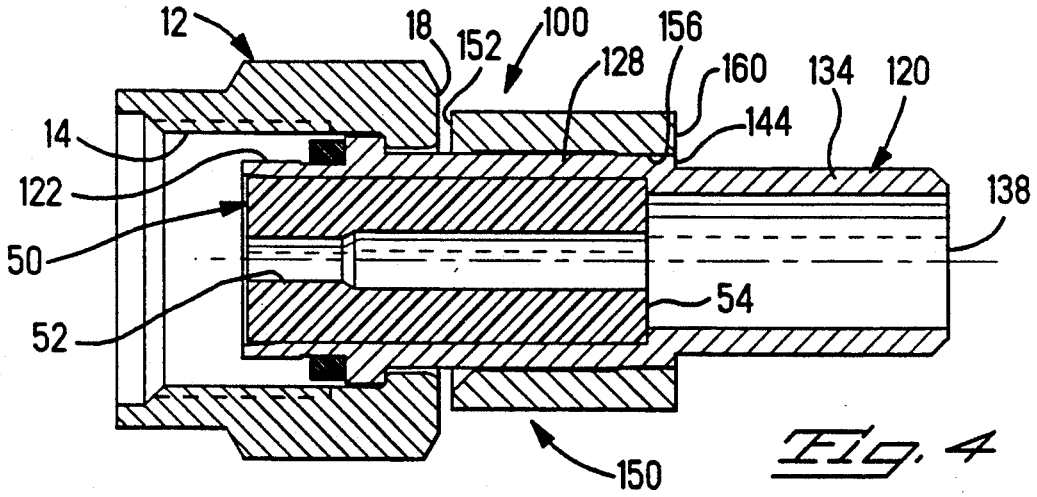
Figure 6:
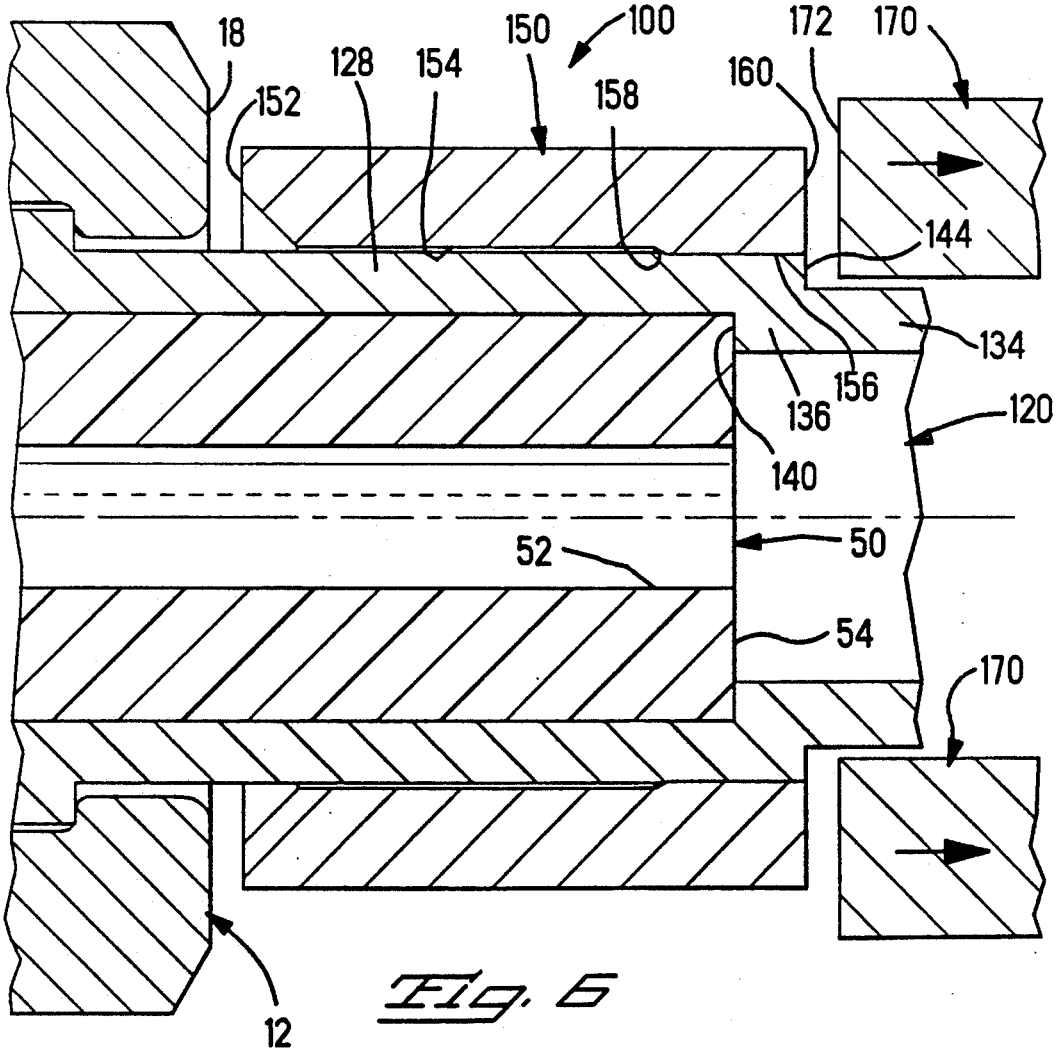

The inside diameter of forward section 154 of retention sleeve 150 is slightly larger than the outside diameter of central section 128 of outer conductor 120, while rearward section 156 has an inside diameter incrementally smaller than the outside diameter of central section 128 by an amount $\delta$ as illustrated in FIG. 5, and generates an interference fit with a portion of central section 128 at transition section 136 as shown in FIG. 6. Tooling 170 can have an annular work end 172 with an inner diameter just larger than the outside diameter of crimping section 134 of outer conductor 120, in order to press retention sleeve onto central section 128 until reaching and abutting rearwardly facing ledge 144 at transition section 136, thereby placing retention sleeve 150 in its final assembled position as seen in FIGS. 4 and 6.

Figure 7:
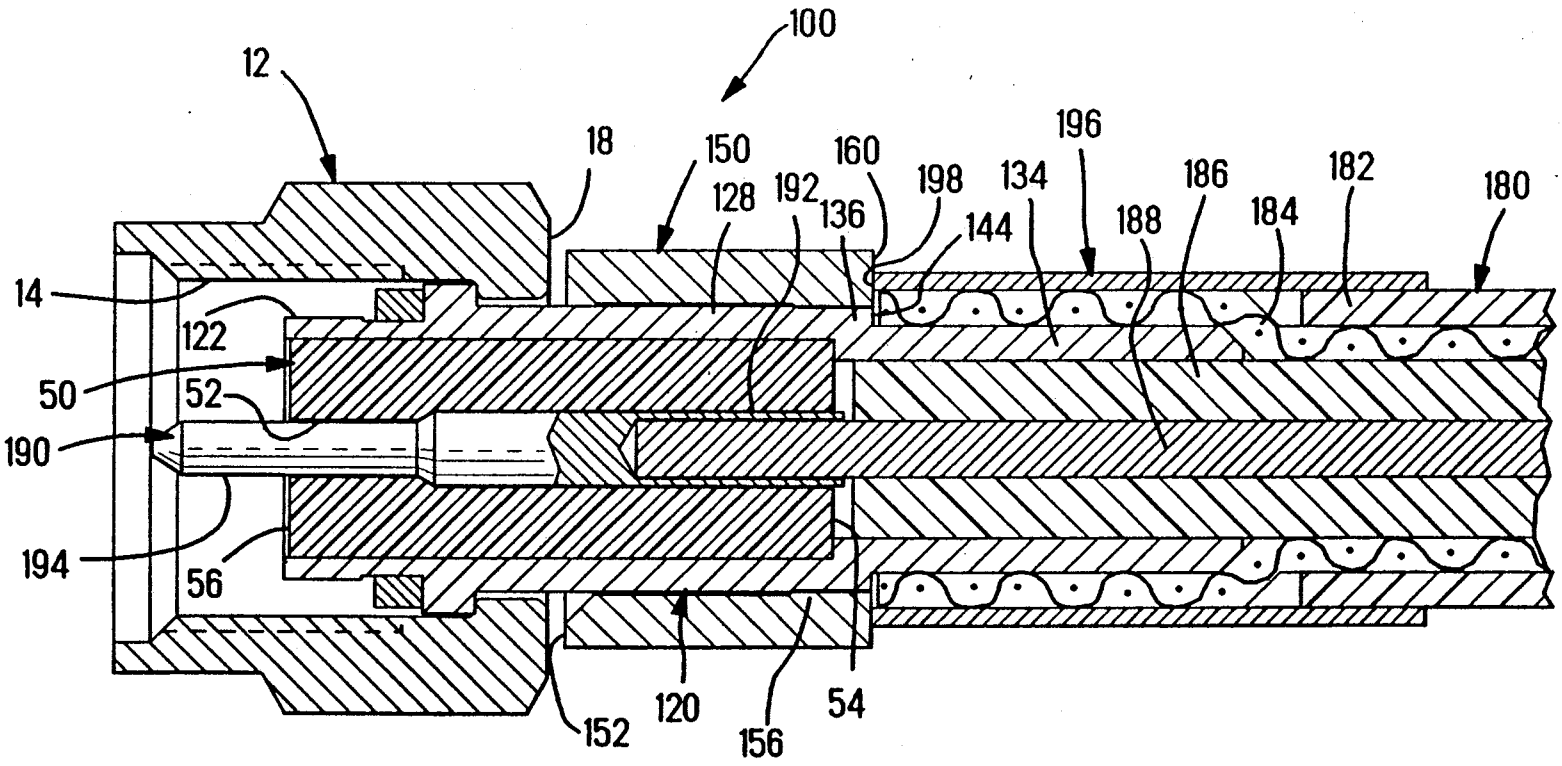
FIG. 7 is section view upon the connector of the present invention being terminated to a coaxial cable, with a crimping ferrule crimping the cable braid to the crimping section of the outer conductor rearward of the retention sleeve.

Connector 100 is shown in FIG. 7 terminated onto a coaxial cable 180 having an outer jacket 182, a shielding braid 184, an inner insulative jacket 186 and an inner or signal conductor 188 onto which is terminated a pin contact 190 such as by a conventional crimping process at crimping barrel 192; pin contact 190 extends through central passageway 52 of dielectric sleeve 50 and includes a pin contact section 194 extending forwardly of forward end 56 of sleeve 50 for mating with a complementary contact of a mating coaxial connector (not shown). Shielding braid 184 is drawn over the outer surface of crimping section 134 of outer conductor 120 and crimping ferrule 196 placed therearound until front edge 198 crimping ferrule 196 abuts the wide ledge defined by surface 144 of outer conductor 120 and rearward end 160 of retention sleeve 150. Crimping ferrule 196 and braid 184 are then crimped as is conventional, thus establishing a grounding connection between braid 184 and outer conductor 120 which has a forwardmost extent just at transition section 136, with all deformation from crimping occurring rearwardly of rearward end 160 of retention sleeve 150.

The retention sleeve may be made for example of 100–110 brass, half hard temper, with the inner diameter of the reduced diameter rearward section being about 0.002 inches less than the outer diameter of the central section of the outer conductor, the amount of $\delta$ (FIG. 5) thus being about 0.001 inches; preferably the reduced diameter rearward section extend along about 0.050 inches of the length of the retention sleeve.

Variations and modifications may be made to the retention sleeve of the present invention which are within the spirit of the invention and the scope of the claims. The retention sleeve of the present invention may be used with outer conductive shells of the prior art containing an annular groove formerly created for crescent rings and which would now be merely innocuous, or it may be used with modified shells.

I claim:

1. An improved coaxial connector of the type having a coupling nut secured about an outer conductive shell and freely rotatable thereabout for threaded coupling to a complementary coaxial connector to secure the connectors together to define an electrical coaxial connection therebetween, appliable to an end of a coaxial cable having a shielding braid to be electrically connected to a rearward end of the outer conductive shell by crimping about a reduced diameter rearward section thereof, the improvement comprising:

a retention sleeve insertable over said reduced diameter rearward section of said outer conductive shell from a rearward end thereof, to overlie a portion of a central section of said outer conductive shell, said retention sleeve having a forward end defining a rearward stop for said coupling nut for retention of said coupling nut about said outer conductive shell, and further having a rearward end defining a forward stop for a crimping ferrule during placement of said crimping ferrule about an end portion of said shielding braid of said cable overlying said reduced diameter rearward section of said outer conductive shell for crimping said shielding braid thereto, said retention sleeve having a forward section having an inner diameter just larger than an outer diameter of said central section of said outer conductive shell, and further having a rearward section having an inner diameter incrementally smaller than an outer diameter of said reduced diameter rearward section of said outer conductive shell, whereby when said retention sleeve is moved forwardly over said outer conductive shell from said rearward end thereof, said forward section coextends over said central shell section and said rearward section defines a force fit with said central shell section for self-retention thereon.

2. An improved coaxial connector as set forth in claim 1 wherein said force fit has an axial length of about 0.050 inches.

* * * * *

UNITED STATES PATENT AND TRADEMARK OFFICE

CERTIFICATE OF CORRECTION

PATENT NO. : 5,161,993

DATED : November 10, 1992

INVENTOR(S) : Richard G. Leibfried, Jr.

It is certified that error appears in the above-identified patent and that said Letters Patent is hereby corrected as shown below:

In Claim 1, Column 5, lines 7 and 8, the lines should read as follows:

"... an inner diameter incrementally smaller than said outer diameter of said central section of said outer conductive shell, ...".

Signed and Sealed this

Fifteenth Day of February, 1994

Bruce Lehman

*Attest:*

BRUCE LEHMAN

*Attesting Officer*

*Commissioner of Patents and Trademarks*